US006735919B1

(12) United States Patent
diGirolamo et al.

(10) Patent No.: US 6,735,919 B1
(45) Date of Patent: May 18, 2004

(54) MODULAR I-BEAM

(75) Inventors: Edward R. diGirolamo, Raleigh, NC (US); Michael L. Torres, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 0 days.

(21) Appl. No.: 09/918,218

(22) Filed: Jul. 30, 2001

(51) Int. Cl.[7] ..... E04C 3/30
(52) U.S. Cl. ..... 52/729.4
(58) Field of Search ..... 248/228.1, 228.5; 52/729.4, 729.1, 730.6, 735.9, 729.3, 731.7, 729.5, 729.2

(56) References Cited

U.S. PATENT DOCUMENTS

| | | | | | |
|---|---|---|---|---|---|
| 518,645 | A | * | 4/1894 | Emery | 52/364 |
| 542,283 | A | * | 7/1895 | Rousseau | 52/729.2 |
| 991,603 | A | * | 5/1911 | Brooks | 52/364 |
| 1,344,229 | A | * | 6/1920 | Hutchinson | 52/731.7 |
| 1,900,541 | A | * | 3/1933 | Buelow et al. | 52/377 |
| 3,328,931 | A | * | 7/1967 | Smith | 52/299 |
| 3,483,665 | A | * | 12/1969 | Miller | 52/461 |
| 4,002,000 | A | | 1/1977 | Howard et al. | 52/729 |
| 4,794,745 | A | * | 1/1989 | Platt et al. | 52/506.07 |
| 4,893,961 | A | * | 1/1990 | O'Sullivan et al. | 403/187 |
| 5,287,675 | A | * | 2/1994 | McGee | 52/770 |
| 5,388,527 | A | * | 2/1995 | Thornton | 104/284 |
| 5,394,906 | A | * | 3/1995 | Farley | 139/192 |
| 5,517,796 | A | * | 5/1996 | Koski et al. | 52/506.07 |
| 5,544,459 | A | * | 8/1996 | Konger | 52/220.3 |
| 5,553,437 | A | | 9/1996 | Navon | 52/729.1 |
| 5,904,022 | A | | 5/1999 | Zadok | 52/650.1 |
| 6,161,361 | A | | 12/2000 | Ehrenkrantz | 52/731.9 |
| 6,256,958 | B1 | * | 7/2001 | Matthews | 52/274 |
| 6,360,510 | B1 | * | 3/2002 | Woodrum et al. | 52/731.1 |
| 6,561,736 | B1 | * | 5/2003 | Doleshal | 405/251 |

* cited by examiner

*Primary Examiner*—Leslie A. Braun
*Assistant Examiner*—A. Joseph Wujciak, III
(74) *Attorney, Agent, or Firm*—Coats & Bennett, P.L.L.C.

(57) ABSTRACT

A modular I-beam comprises first and second sets of nested channels disposed in back-to-back relation to one another and fastened together. The modular I-beam may further include a central beam disposed between the first and second sets of nested channels.

63 Claims, 5 Drawing Sheets

MODULAR I-BEAM

FIELD OF THE INVENTION

The present invention related generally to steel beams and, more particularly, to a modular steel beam that can be assembled in place.

BACKGROUND OF THE INVENTION

Trends in residential building call for large, open spaces and high ceilings, creating a demand for structural members that provide higher strength and greater stability over longer spans than conventional lumber. Engineered lumber, such as wood I-beams, laminated veneer lumber (LVL), and glulam beams, are often used in place of conventional lumber in residential designs where high loads and/or long spans are present. Engineered lumber, however, is more expensive than conventional lumber and, therefore, increases the cost of construction. Also, engineered lumber is frequently custom-designed for a particular application, creating a logistical problem for the builder, who must coordinate the design, manufacture, and transportation of the engineered lumber to the work site.

Structural steel, such as steel trusses and I-beams, provide another alternative to conventional lumber in residential designs where high loads and/or long spans are present. Steel members are relatively inexpensive and come in a wide variety of sizes and shapes which are readily available. However, large steel members can be difficult to handle due to their size and weight. Oftentimes, special equipment such as cranes or other lifting equipment is needed to put steel members in place.

Accordingly, there is still a need for structural members for residential construction that provide greater strength and stability over long spans than conventional lumber, yet are relatively inexpensive, readily available, and easily handled on the work site.

BRIEF SUMMARY OF THE INVENTION

The present invention is a modular steel I-beam that can be assembled in place at a construction site. In one embodiment, the modular I-beam comprises a plurality of nested steel channels fastened to a central beam made of wood to form an I-beam. The builder chooses the size and number of steel channels to fasten to the central beam depending upon the requirements of a particular application. The steel channels may be combined in a variety of ways, allowing the builder to effectively build a custom designed I-beam for a given application.

In one exemplary embodiment of the invention, the nested channels are provided in paired sets. Each paired set comprises an outer channel and an inner channel. The outer and inner channels each comprise two flanges connected by a central web. The outer ends of the flanges are angled inwardly toward a midline of the channel. In the preferred embodiment, the flanges of the inner channel angle outwardly such that the flanges of the inner channel bear against the flanges of the outer channel. This arrangement makes the inner channel self-aligning with respect to the outer channel and facilitates assembly at the construction site. The inner channel effectively snaps into the outer channel and the angle on the outer end of the flanges for the outer channel helps retain the inner channel in a nested position.

An I-beam may be constructed by arranging two paired channels on each side of a central beam. Additional paired channels can then be nested inside the first set of paired channels. The nesting of paired channels may continue until a beam with the desired strength characteristics is formed.

DETAILED DESCRIPTION OF THE INVENTION

Figure 1:
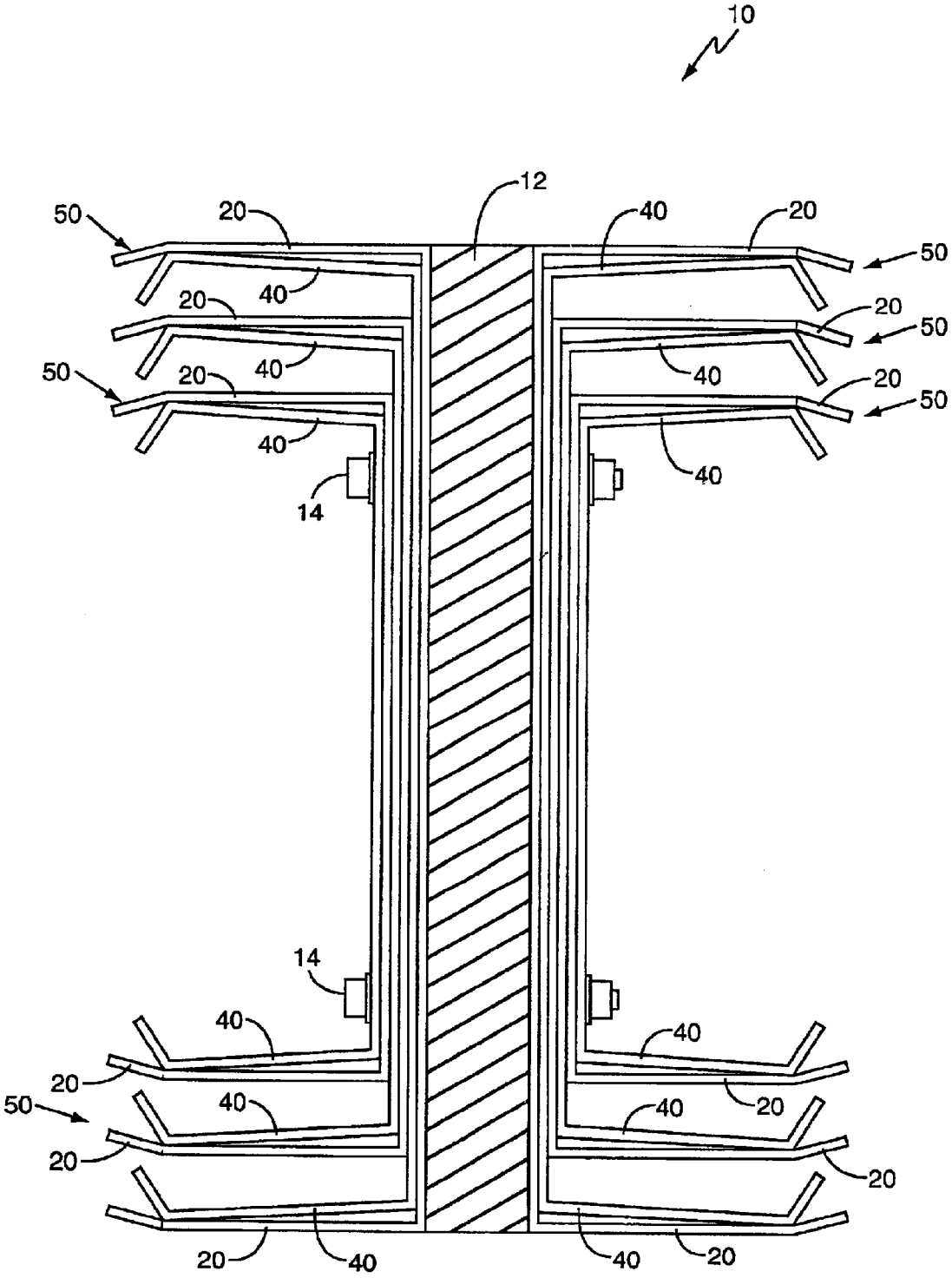
FIG. 1 is a cross-sectional view of the modular I-beam of the present invention.

Referring now to the drawings, and particularly to FIG. 1, the modular I-beam of the present invention is shown therein and indicated generally by the numeral 10. The modular I-beam 10 comprises a plurality of nested channels 20, 40, disposed in back-to back relation to one another and fastened to a central beam 12 made of wood or other suitable materials. It should be pointed out that the nested channels 20, 40 can themselves be disposed in back-to-back relationship. That is, in some designs, such as where an all steel construction is desired, the central beam 12 would be unnecessary. The nested channels 20, 40 are grouped into two sets. One set of nested channels 20, 40 forms one side of the modular I-beam and the other set of nested channels 20, 40 forms the opposite side of the modular I-beam 10. In the embodiment shown in FIG. 1, the nested channels 20, 40 are secured to the central beam 12 by threaded fasteners 14 that passed through aligned openings in the nested channels 20, 40. The threaded fasteners 14 may, for example, comprise a conventional bolt and nut. Other types of fasteners, such as nails, rivets, or screws, may be used to secure the nested channels 20, 40 to the central beam 12.

Each set of nested channels 20, 40 comprises one or more channel pairs 50. In FIG. 1, there are three channel pairs 50 within each set of nested channels. The number of channel pairs 50 needed will depend on the strength requirements of a particular application. In general, a modular I-beam constructed in accordance with the present invention may have one or more channel pairs 50.

Figure 2:
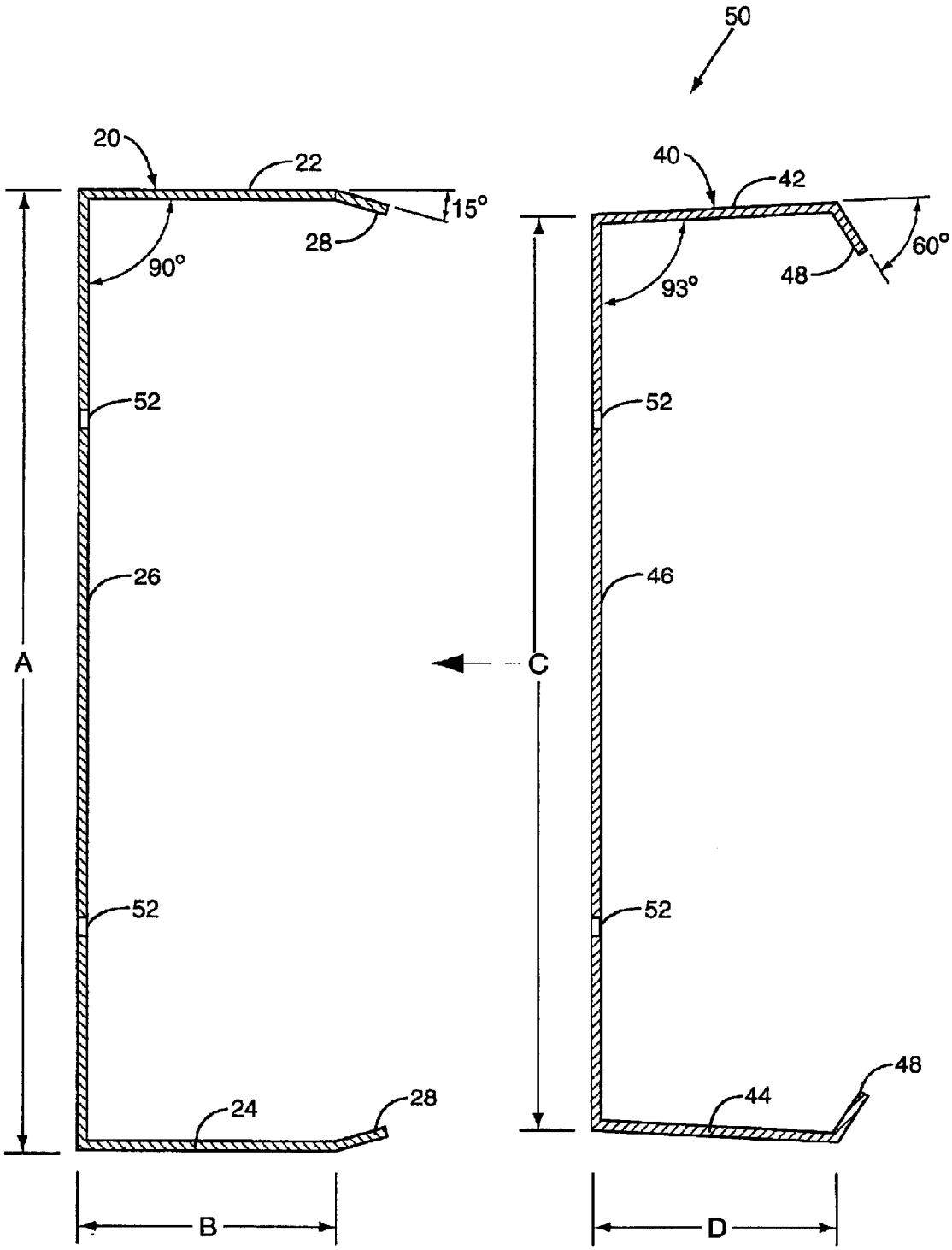
FIG. 2 is an exploded cross-section of a channel pair used to make the modular I-beam of the present invention.

FIG. 2 is an exploded cross-sectional view of a single channel pair 50. The channel pair 50 comprises an outer channel 20 and an inner channel 40. Both channels 20, 40 are formed from a particular gauge steel, such as a 10-gauge steel. The outer channel 20 comprises a top flange 22 and a bottom flange 24 connected together by a central web 26. The top flange 22 and bottom flange 24 may include an outer end portion 28 that angles inwardly toward a midline of the channel 20 at an angle of approximately 15°. The angled end portions 28 provide greater strength and rigidity to the I-beam 10. While the top flange 22 and bottom flange 24 both include angled end portions 28 in the disclosed embodiment, such is not required. Alternatively, only the top flange 22 could include an angled end portion 28 and, in any case, the angle may vary.

Channel 40 also comprises a top flange 42 and bottom flange 44 connected by a central web 46. The top flange 42 and bottom flange 44, angle outwardly at a slight angle away from the center line of the channel 40. In the disclosed embodiment, the top flange 42 and bottom flanges 44 form an angle of approximately 90° with the central web 46. Top flange 42 and bottom flange 44 may include an outer end portion 48 that angles inwardly toward the midline of the channel 40. Outer end portions 48 form an angle of approximately 60° to the top and bottom flanges 42 and 44. While the top flange 42 and bottom flange 42 both include angled end portions 48, such is not required. Alternatively, only the top flange 42 could include an angled end portion 48.

In the preferred embodiment of the invention, the inner channel 40 is sized to fit into the outer channel 20 in a nested fashion with the top and bottom flanges 42 and 44 of the inner channel 40 bearing against the top and bottom flanges 22 and 24 of the outer channel 20 to help align the inner channel 40 with respect to the outer channel 20. The inner channel 40 and outer channel 20 include a series of aligned openings 52. The function of the aligned openings 52 is to receive fasteners, such as threaded fasteners, nails, or screws. The aligned openings 52 may be of varying size. For example, some of the aligned openings 52 may be designed to receive nails used to tack the channels 20, 40 to the central beam 12 during assembly of the beam 10, as will be hereinafter described. Some of the aligned openings 52 may be larger and adapted to receive the threaded fasteners 14 which provide the primary securing force for holding the parts of the modular I-beam 10 together.

Channels 20, 40 may come in a wide variety of sizes. Table 1 below gives dimensions for three exemplary channel pairs 50. The dimensions A, B, C, and D are labeled in FIG. 2.

TABLE 1

Dimensions for Representative Channel Pairs

| Outer Channel 20 | | Inner Channel 40 | |
|---|---|---|---|
| A | B | C | D |
| 13.25 | 3.5 | 12.597 | 3.375 |
| 11.25 | 3.5 | 10.597 | 3.375 |
| 9.25 | 3.5 | 8.597 | 3.375 |

Figure 3A:
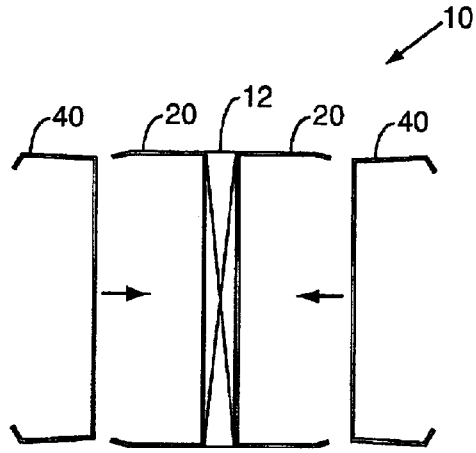
FIGS. 3A–3C illustrate how the modular I-beam of the present invention is assembled in place.
Figure 3B:
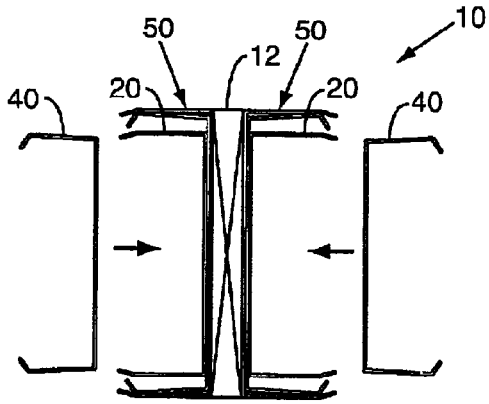
Figure 3C:
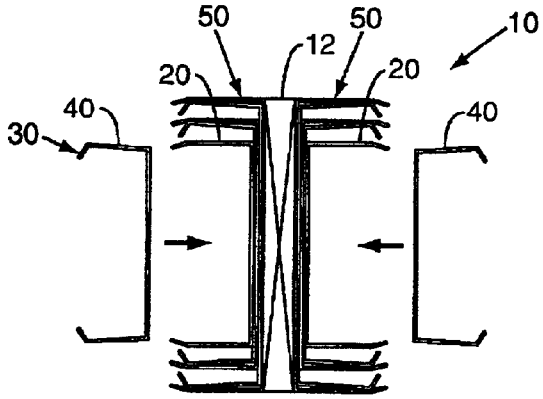

Using the present invention, a modular I-beam meeting desired size and strength requirements can be assembled on site. To assemble a modular I-beam 10, the central beam 12 is first put in place and secured by any suitable means. Once the central beam 12 is in place, channel members 20, 40 may be secured to the central beam 12 one at a time as shown in FIGS. 3A–3C. In FIG. 3A, the outer channel 20 of a first channel pair 50 is attached on each side of the central beam 12. The outer channel 20 may be held in place temporarily by nails that pass through openings 52 in the channel 20 into the central beam 12. Once the outer channel 20 is secured to the central beam 12, the matching inner channel 40 is inserted into the outer channel 20 and tacked in place using nails or screws. Additional channel pairs 50, each one getting progressively smaller than the previous one, may be added to the modular I-beam 10 until the desired strength requirement is met. FIGS. 3B and 3C show the addition of second and third channel pairs 50 respectively to the modular I-beam 10. Each time a channel 20, 40 is added to the modular I-beam 10, it may be tacked in place using nails or screws. Once all the desired channels 20, 40 are put in place, they may be secured in place by threaded fasteners 14 as shown in FIG. 1.

Figure 4:
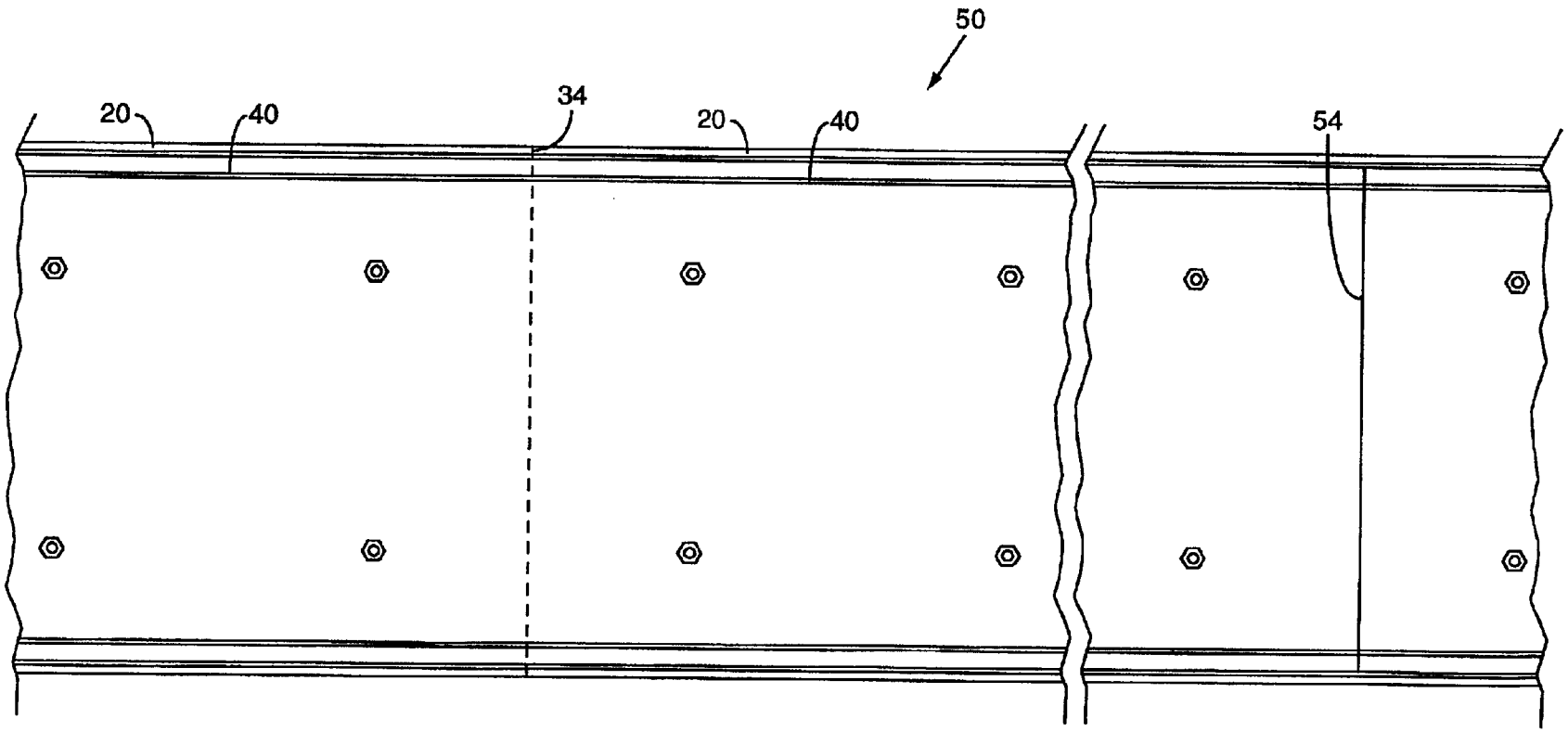
FIG. 4 is a side elevational view of a single channel pair used to make the modular I-beam.

It is contemplated that the channel members 20, 40 according to the present invention will come in certain standard lengths. For long spans, it may be necessary to put channel members 20, 40 end-to-end to construct a modular I-beam 10 for a long span. When constructing a modular I-beam 10 for a long span, it may be desirable to offset the inner channel joints and the outer channel joints in each channel pair 50. This technique of offsetting joints is shown in FIG. 4, which shows a side elevational view of a single channel pair 50. As shown in FIG. 4, the joints 34 between adjacent channel members 20 is offset with respect to the joints 54 of adjacent inner channel members 40. Offsetting joints 34 and 54 in this manner provide greater strength and stability.

Figure 1A:
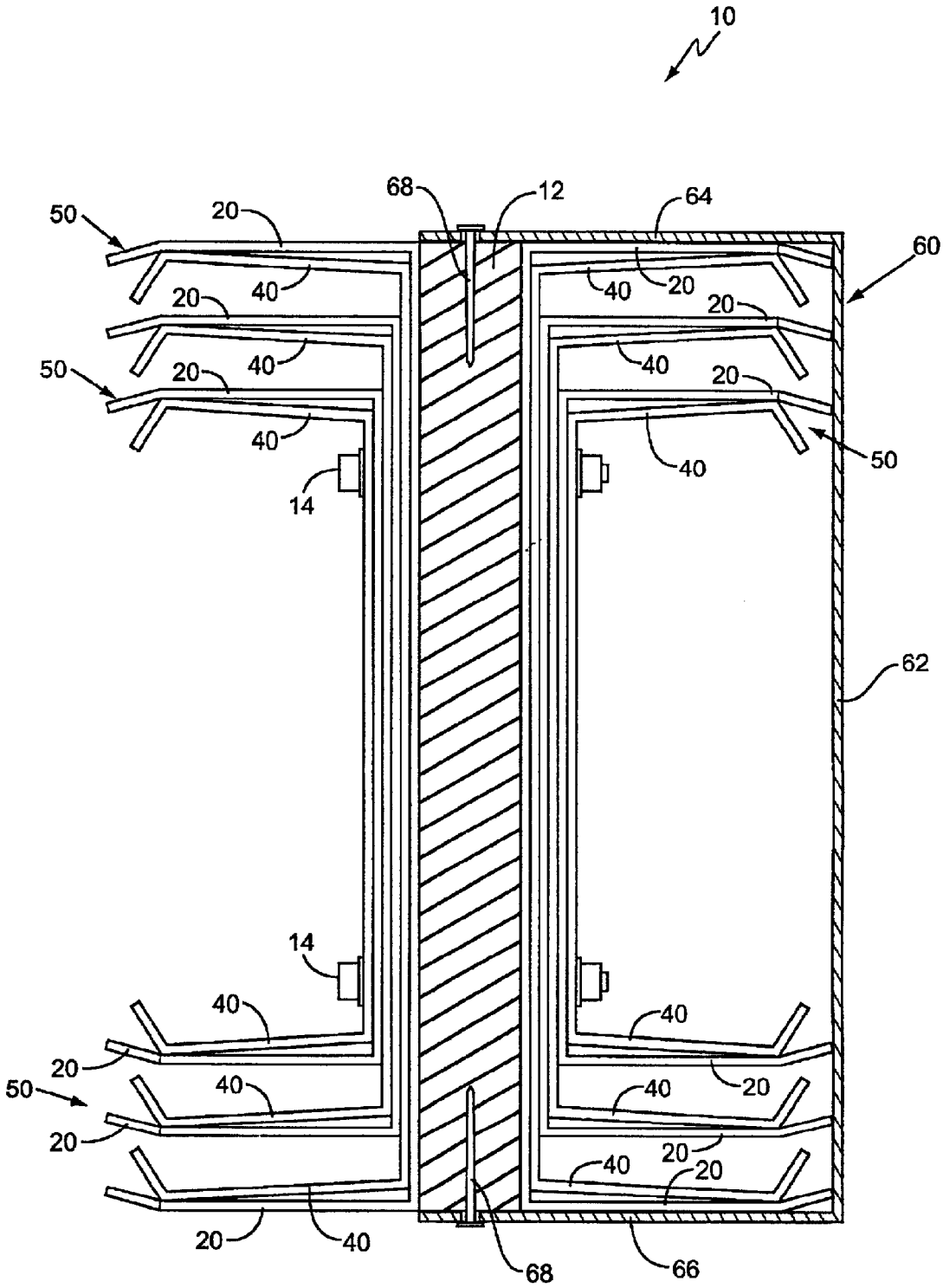
FIG. 1A is a cross-sectional view of the moldular I-beam having a closure channel extending around one side of the beam.

FIG. 1A illustrates an alternative design for the modular I-beam 10. A closure channel, indicated generally by the numeral 60, extends around one side of the beam 10 and basically encloses the sets of nested channels disposed on one side of the beam. It should be appreciated, that the closure panel 60 can be utilized on either side of the beam and in some cases may even be employed on both sides of the beam. While closure channel 60 may be constructed of various materials, it is contemplated that the closure channel 60 would be constructed of steel. As illustrated in figure 1A, the closure 60 includes a face plate 62, and upper and lower plate 64 and 66. Plate 62, 64 and 66 can be connected by various means such as weldment or by bolt assemblies. To secure the closure channel 60 to the beam 10, the upper and lower plate 64 and 66 are provided with spaced apart pre-drilled holes. A series of nails 68 extend downwardly through the drilled holes into the central beam 12. If the central beam 12 is not present, the upper and lower plate 64 and 66 can be screwed to the top and bottom flanges of one of the nested channels.

In the case of the modular I-beam 10 shown in FIG. 1A, joists can be connected in a flush condition directly to the face plate 64. This design offers advantages and conveniences in certain situations. For example, by connecting joists flush to the beam 10, the beam 10 and joists lie in substantially the same plane, thus obviating the necessity of boxing in and finishing around the beam, and in the case of ceiling joists, avoiding the beam being disposed below the ceiling. In the case of the design of FIG. 1, where there is no closure channel 60, the beam 10 is utilized in what is referred to as a drop header condition. Here the joists simply set on top of the beam 10.

In the embodiment illustrated herein, the modular I-beam 10 is shown to include a central beam 12 made of wood or other suitable material. It should be appreciated that the modular I-beam 10 of the present invention may simply comprise a plurality of nested channels that are secured in back-to-back relationship without the presence of a central beam being interposed between the channels. Further, the channels have been described as being nested together. This means one channel within another and does not imply that the flange portions of any nested pair must engage each other.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A modular I-beam comprising:

a. a first set of elongated nested channels;

b. a second set of elongated nested channels disposed in back-to-back relation with said first set of elongated nested channels;

c. each channel including a web;

d. a central beam disposed between the first and second sets of nested channels; and e. one or more fasteners extending through the webs of the channels and securing said first and second sets of elongated nested channels together.

2. The modular I-beam of claim 1 wherein said first and second sets of nested channels are constructed of steel and comprise at least one channel pair.

3. The modular I-beam of claim 2 wherein each said channel pair comprises an outer channel and an inner channel, said outer and inner channels each comprising a top flange, a bottom flange, and a central web connecting said top and bottom flanges.

4. The modular I-beam of claim 3 wherein said top flange of each said outer channel includes an outer end portion that angles inwardly towards a midline of said channel.

5. The modular I-beam of claim 4 wherein said bottom flange of each said outer channel includes an outer end portion that angles inwardly towards a midline of said channel.

6. The modular I-beam of claim 4 wherein said top flange of each said inner channel includes an outer end portion that angles inwardly towards a midline of said channel.

7. The modular I-beam of claim 6 wherein said bottom flange of each said inner channel includes an outer end portion that angles inwardly towards a midline of said channel.

8. The modular I-beam of claim 6 wherein the angle of inclination of said outer end of said inner channel is greater than the angle of inclination of said outer end of said outer channel.

9. The modular I-beam of claim 3 wherein said top and bottom flanges of said inner channels angle outwardly away from a midline of said channel to engage said top and bottom flanges respectively of said outer channel.

10. The modular I-beam of claim 2 wherein said first and second sets of channels each comprise at least two pairs of channels.

11. The modular I-beam of claim 1 wherein said fasteners comprise nails that pass through said channels into said central beam.

12. The modular I-beam of claim 1 wherein said channels in said first set of channels include one or more aligned openings to receive said fasteners.

13. The modular I-beam of claim 12 wherein said channels in said second set of channels include one or more aligned openings to receive said fasteners.

14. The modular I-beam of claim 13 wherein said fasteners comprise threaded fasteners that pass through said aligned openings in said first and second sets of channels.

15. The modular I-beam of claim 13 wherein said openings in said first set of channels align with said openings in said second set of channels.

16. The modular I-beam of claim 1 wherein at least one channel in each set of nested channels includes a top flange with an outer end portion that angles inwardly toward a midline of said channel.

17. The modular I-beam of claim 16 wherein the outermost channel in each set of nested channels includes a top flange with an outer end portion that angles inwardly toward a midline of said channel.

18. The modular I-beam of claim 1 including at least one plate for permitting joists to be flush mounted to the modular I-beam.

19. The modular I-beam of claim 1 including at least one closure channel extending at least partially around one of said first and second sets of nested channels.

20. The modular I-beam of claim 19 wherein the closure channel includes an outer face plate for permitting joists to be flush-connected thereto.

21. The modular I-beam of claim 19 wherein the closure channel includes an outer face plate and upper and lower plates with the upper and lower plates being connected at generally top and bottom areas of the I-beam.

22. The modular I-beam of claim 21 further comprising a central beam disposed between said first and second sets of channels and wherein the upper and lower plates of the closure channel are secured to the central beam.

23. A modular I-beam comprising:

a) a central beam;

b) a first set of elongated nested channels disposed on one side of said central beam;

c) a second set of elongated nested channels disposed on a second side of said central beam and oriented in a direction opposite said first set of elongated nested channels; and d) one or more fasteners securing said first and second sets of elongated nested channels to said central beam.

24. The modular I-beam of claim 23 wherein said first and second sets of nested channels comprise at least one channel pair.

25. The modular I-beam of claim 24 wherein each said channel pair comprises an outer channel and an inner channel, said outer and inner channels each comprising a top flange, a bottom flange, and a central web connecting said top and bottom flanges.

26. The modular I-beam of claim 25 wherein said top flange of each said outer channel includes an outer end portion that angles inwardly towards a midline of said channel.

27. The modular I-beam of claim 26 wherein said bottom flange of each said outer channel includes an outer end portion that angles inwardly towards a midline of said channel.

28. The modular I-beam of claim 26 wherein said top flange of each said inner channel includes an outer end portion that angles inwardly towards a midline of said channel.

29. The modular I-beam of claim 28 wherein said bottom flange of each said inner channel includes an outer end portion that angles inwardly towards a midline of said channel.

30. The modular I-beam of claim 28 wherein the angle of inclination of said outer end of said inner channel is greater than the angle of inclination of said outer end of said outer channel.

31. The modular I-beam of claim 25 wherein said top and bottom flanges of said inner channels angle outwardly away from a midline of said channel to engage said top and bottom flanges respectively of said outer channel.

32. The modular I-beam of claim 24 wherein said first and second sets of channels each comprise at least two pairs of channels.

33. The modular I-beam of claim 23 wherein said channels in said first set of channels include one or more aligned openings to receive said fasteners.

34. The modular I-beam of claim 33 wherein said channels in said second set of channels include one or more aligned openings to receive said fasteners.

35. The modular I-beam of claim 34 wherein said openings in said first set of channels align with said openings in said second set of channels.

36. The modular I-beam of claim 23 wherein said fasteners comprise threaded fasteners that pass through said aligned openings in said first and second sets of channels.

37. The modular I-beam of claim 23 wherein said fasteners comprise nails that pass through said channels into said central beam.

38. The modular I-beam of claim 23 wherein at least one channel in each set of nested channels includes a top flange with an outer end portion that angles inwardly toward a midline of said channel.

39. The modular I-beam of claim 38 wherein the outermost channel in each set of nested channels includes a top flange with an outer end portion that angles inwardly toward a midline of said channel.

40. The modular I-beam of claim 23 including at least one plate for permitting joists to be flush-mounted to the modular I-beam.

41. The modular I-beam of claim 40 wherein the plate forms a part of a closure panel that extends at least partially around one of said first and second sets of nested channels.

42. A modular I-beam of claim 41 wherein the closure channel includes an upper plate and a lower plate and wherein the upper and lower plates are secured to the central beam.

43. A method of constructing a modular I-beam, said method comprising:

a. forming a first set of elongated nested channels;

b. forming a second set of elongated nested channels;

c. disposing said first and second sets of elongated nested channels in back-to-back relation to one another;

d. disposing a central beam between the two sets of nested channels; and e. fastening said first and second sets of elongated nested channels together by inserting at least one fastener through webs that form a part of each set of nested channels.

44. The method of claim 43 wherein forming said first and second sets of nested channels comprises nesting an inner channel inside an outer channel to form at least one channel pair.

45. The method of claim 44 further comprising angling the top and bottom flanges of said inner channel outwardly from a midline of said inner channel to engage top and bottom flanges respectively of said outer channel.

46. The method of claim 43 wherein each said nested channel comprises a top flange, a bottom flange, and a central web connecting said top and bottom flanges.

47. The method of claim 46 further comprising bending an outer end portion of the top flange for at least one of said nested channels inwardly toward a midline of said channel to increase the strength of said modular I-beam.

48. The method of claim 47 further comprising bending an outer end portion of the top flange for each said nested channel inwardly toward a midline of said channel to increase the strength of said modular I-beam.

49. The method of claim 46 further comprising bending an outer end portion of said top and bottom flanges for at least one of said nested channels inwardly toward a midline of said channel to increase the strength of said modular I-beam.

50. The method of claim 43 further comprising:

a) forming aligned openings in said nested channels;

b) inserting said fasteners through said aligned openings to secure said first and second sets of nested channels to said central beam.

51. The method of claim 50 wherein said first and second sets of channels are fastened to said central beam by threaded fasteners.

52. The method of claim 50 wherein said first and second sets of channels are fastened to said central beam by nails.

53. The method of claim 50 wherein said first and second sets of channels are fastened to said central beam by screws.

54. The method of claim 43 further comprising:

a. forming aligned openings in the webs of said nested channels; and b. inserting a series of fasteners through said aligned openings in the webs to secure said first and second sets of nested channels together.

55. The method of claim 54 wherein said first and second sets of channels are fastened together by threaded fasteners that pass through said aligned openings in said nested channels.

56. The method of claim 43 including securing at least one member to the modular I-beam for permitting joists to be flush-mounted to the member.

57. The method of claim 43 including extending a plate outwardly of one of the first and second sets of channels such that joists can be flush mounted to the plate.

58. The method of claim 43 including extending a support structure around one of said first or second sets of channels such that the support structure may be utilized to mount joists thereto.

59. A modular I-beam comprising:

a. a first set of nested channels;

b. a second set of nested channels disposed in back-to-back relationship with said first set of nested channels;

c. each of said first and second sets of channels comprising at least two pairs of channels; and d. one or more fasteners securing said first and second sets of nested channels together.

60. The modular I-beam of claim 59 wherein each said channel pair comprises an outer channel and an inner channel, said outer and inner channels each comprising a top flange, bottom flange, and a central web connecting said top and bottom flanges.

61. The modular I-beam of claim 59 wherein said channels in said first and second sets of channels include one or more aligned openings; and wherein said fasteners comprise threaded fasteners that pass through said aligned openings in said first and second sets of channels.

62. A method of constructing a modular I-beam, comprising:

a. forming a first set of nested channels;

b. forming a second set of nested channels;

c. disposing said first and second sets of nested channels in back-to-back relation to one another;

d. inserting a central beam between said first and second sets of channels;

e. fasatening said first and second sets of channels to said central beam.

63. The method of claim 62 further comprising forming aligned opening in said nested channels; and inserting said fasteners through said aligned openings to secure said first and second set of nested channels to said central beam.

* * * * *